United States Patent [19]

Fehr et al.

[11] Patent Number: 4,666,133

[45] Date of Patent: May 19, 1987

[54] WALL MEMBER FOR CONVERTER CHAMBER

[75] Inventors: Kurt Fehr; Ivo Henych; Rudolf Pavlovsky, all of Schaffhusen, Switzerland

[73] Assignee: Georg Fischer Aktiengesellschaft, Schaffhausen, Switzerland

[21] Appl. No.: 808,869

[22] Filed: Dec. 13, 1985

[30] Foreign Application Priority Data

Jan. 29, 1985 [CH] Switzerland ..... 378/85

[51] Int. Cl.[4] ..... C21C 7/00

[52] U.S. Cl. ..... 266/216; 75/53

[58] Field of Search ..... 266/216; 75/53, 58

[56] References Cited

U.S. PATENT DOCUMENTS 3,724,829 4/1973 Alt ..... 266/216

3,747,912 7/1973 Wernli ..... 266/216

*Primary Examiner*—Peter D. Rosenberg

*Attorney, Agent, or Firm*—Toren, McGeady and Goldberg

[57] ABSTRACT

A wall member for a converter chamber for the treatment of cast iron melt with magnesium. The size and shape of the wall member of a converter have a decisive influence on the efficiency of the treatment of a cast iron metal in a converter and on the accuracy of obtaining a residual magnesium content. For an optimum control of this influence, the length L of the wall member is determined in accordance with the formula $L=600\times T^{0.45}\times A$ and the height H is determined in accordance with the formula $H=0.5\ L\times A$, wherein A is a coefficient ranging between 0.5 to 1.5 depending upon the sulfur content of 0.01 to 0.15% by weight and depending upon the thickness of the refractory lining of the converter vessel ranging from 40 to 150 mm.

5 Claims, 4 Drawing Figures

WALL MEMBER FOR CONVERTER CHAMBER

BACKGROUND OF THE INVENTION

The present invention relates to a wall member for forming a chamber within a converter for the treatment of cast iron melts with magnesium.

A converter for the treatment of cast iron melt with magnesium has on the bottom of the converter a chamber which is separated from the melt by a chamber wall. The chamber wall defines a certain number of openings at different heights relative to the bottom of the converter. During and after the converter is swung from its horizontal filling position into its vertical treatment position, the cast iron melt penetrates into the chamber through the bottommost opening and vaporizes the magnesium in a controlled fashion. The magnesium vapors escape from the chamber into the cast iron melt through the upper openings. A certain amount of magnesium must be added to a quantity of cast iron having a certain sulfur content, so that the initial sulfur content of, for example, 0.1% is reduced to 0.006% and a residual magnesium amount of, for example, 0.045% in the cast iron melt is obtained.

For the aforementioned reason, the wall defining the chamber must have a certain shape and size in relation to the quantity of cast iron melt to be treated. If the chamber volume is selected either too small or too large, the efficiency of the treatment is reduced and the accuracy of obtaining the predetermined residual magnesium amount in the cast iron melt is also impaired.

It is, therefore, the primary object of the present invention to provide a wall for a converter chamber having a size and shape in relation to the quantity of cast iron melt to be treated which ensures a high efficiency of the treatment of the cast iron melt with magnesium and makes it possible to achieve a high accuracy in obtaining a predetermined residual amount of magnesium in the cast iron melt.

SUMMARY OF THE INVENTION

In accordance with the present invention, a wall member or a converter chamber for the treatment of cast iron melt with magnesium has an arcuate or angular shape and defines a certain number of openings. The openings are arranged at different height levels from the bottom of the converter. Length L in millimeters of the chamber wall in relation to the quantity T in tons of the cast iron melt is determined in accordance with the formula $L=600\times T^{0.45}\times A$ and the height H in millimeters of the wall is determined in accordance with the formula $H=0.5L\times A$, wherein A is a coefficient ranging between 0.5 to 1.5 depending upon the sulfur content of 0.01 to 0.15% and depending upon the thickness of the refractory lining of the converter vessel of 40 to 150 mm.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
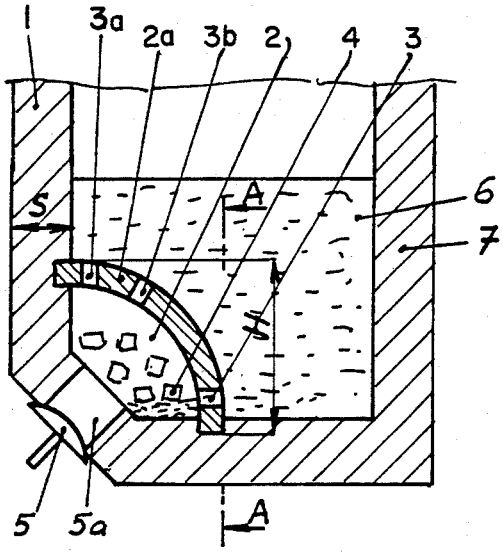
FIG. 1 is a schematic sectional view showing the bottom area of the converter with a chamber wall having an arcuate shape.
Figure 2:
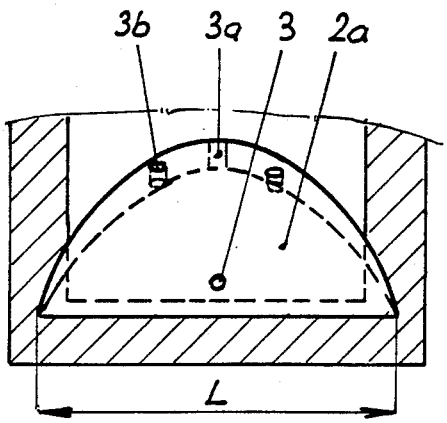
FIG. 2 is a schematic cross-sectional view along line A—A in FIG. 1.
Figure 3:
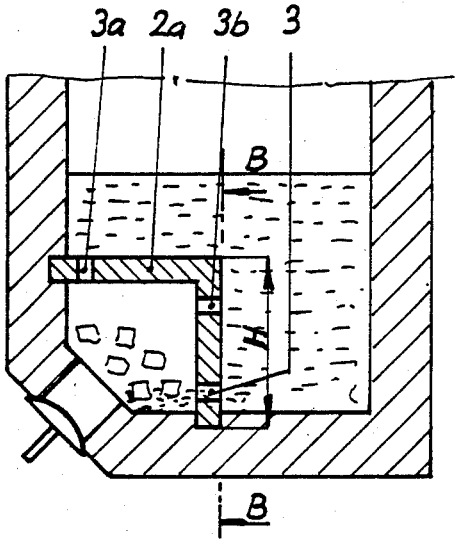
FIG. 3 is a schematic sectional view of the bottom area of the converter with a chamber wall having an angular shape.
Figure 4:
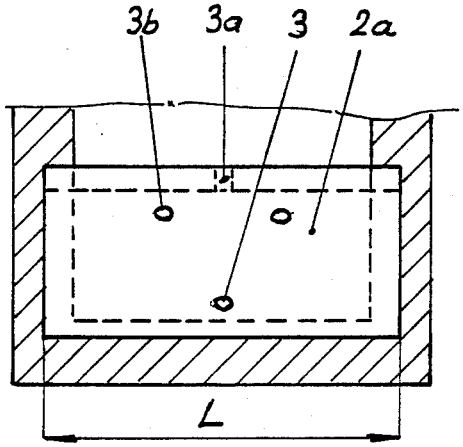
FIG. 4 is a schematic cross-sectional view along line B—B of FIG. 3.

As illustrated in the drawing, a chamber 2 is arranged within a vessel 1. Magnesium 4 is placed in chamber 2 through opening 5*a* which can be closed by means of a closure 5. A wall 2*a* of chamber 2 has openings 3, 3*a*, 3*b* which have different functions. Opening 3 serves to permit metal melt 6 to flow into chamber 2, while the vapors of the magnesium 4 leave chamber 2 through openings 3*a*, 3*b*. Vessel 1 is swung in the known fashion from a horizontal position, not illustrated in the drawing, into the vertical treatment position as illustrated in FIGS. 1 and 3, so that the vaporization of the magnesium is commenced at the moment the cast iron melt 6 penetrates through opening 3 into chamber 2.

The length L in millimeters of the chamber wall 2*a* is determined in relation to the quantity T in tons of cast iron melt 6 to be treated in accordance with the formula $L=600\times T^{0.45}\times A$ and the height H in millimeters of the chamber wall 2*a* is determined in accordance with the formula $H=0.5L\times A$. Coefficient A ranges from 0.5 to 1.5 depending upon the sulfur content of 0.01 to 0.15% and depending upon thickness S of the refractory lining 7 of vessel 1 ranging from 40 to 150 mm.

The total cross-sectional area F in $cm^2$ of the openings 3, 3*a*, 3*b* in chamber wall 2*a* is determined in accordance with the formula $F=7.3\times T^{0.3}\times B$, wherein T again is the quantity in tons of the cast iron melt 6 to be treated. Coefficient B ranges from 0.6 to 1.4 depending upon the sulfur content of 0.01 to 0.15%.

The total cross-sectional area of openings 3, 3*a*, 3*b* is advantageously distributed, so that one or more lower openings 3 constitute 25–45% of the cross-sectional area, and that one or more upper openings 3*a* constitute 15–35% of the cross-sectional area and that one or more middle openings 3*b* constitute 35–55% of the cross-sectional area.

The chamber wall 2*a* may have an arcuate shape as illustrated in FIG. 1 or an angular shape as illustrated in FIG. 3. Vessel 1 may have a round shape as illustrated in FIG. 1 or an angular shape as illustrated in FIG. 3.

While specific embodiments of the invention have been shown and described in detail to illustrate the application of the inventive principles, it will be understood that the invention may be embodied otherwise without departing from such principles.

We claim:

1. In a converter vessel for the treatment of cast iron melt with magnesium, with the converter vessel having a planar converter bottom and wall means extending upwardly from the converter bottom, a wall member located within the converter vessel and forming in combination with the converter bottom and wall means a chamber extending upwardly from the converter bottom, said wall member having a length L in millimeters extending parallel to the converter bottom and a height H in millimeters extending upwardly from the converter bottom, said wall member defining a plurality of openings located at different height levels above the converter bottom with the openings communicating between the interior of said converter vessel and the interior of said chamber, the improvement comprising that in relation to the quantity T in tons of the cast iron melt the length L of the wall member is determined in accordance with the formula $L=600\times T^{0.45}\times A$ and the height H of the wall member is determined in accordance with the formula $H=0.5L\times A$, wherein A is a coefficient ranging between 0.5 to 1.5 depending upon the sulphur content of the cast iron melt in the range of 0.01 to 0.15% and depending upon the thickness S of refractory lining of the converter vessel ranging from 40 to 150 mm.

2. In a converter vessel as set forth in claim 1, wherein the wall member in section extending upwardly from the converter bottom has an arcuate shape.

3. In a converter vessel as set forth in claim 1, wherein the wall member in section extending upwardly from the converter bottom has an angular shape.

4. In a converter vessel as set forth in claim 1, wherein the total cross-sectional area F in $cm^2$ of the openings of the wall member is determined in accordance with the formula $F=7.3\times T^{0.3}\times B$, wherein T is the quantity of cast iron melt in tons and B is a coefficient ranging from 0.6 to 1.4 depending upon the sulfur content of the cast iron melt ranging from 0.01 to 0.15%.

5. In a converter vessel as set forth in claim 4, wherein the wall member has a top portion, a middle portion and a bottom portion in the height direction of the wall member, and the total cross-sectional area of the openings is distributed so that the openings in the bottom portion constitute 25–45% of the total cross-sectional area, the openings in the top portion constitute 15–35% of the total cross-sectional area and the openings in the middle portion constitute 35–55% of the total cross-sectional area.

* * * * *